US011199061B2

(12) United States Patent
Mustafa et al.

(10) Patent No.: US 11,199,061 B2
(45) Date of Patent: Dec. 14, 2021

(54) CLOSED HOLE CIRCULATION DRILLING WITH CONTINUOUS DOWNHOLE MONITORING

(71) Applicant: Weatherford Technology Holdings, LLC, Houston, TX (US)

(72) Inventors: Dauren Mustafa, Houston, TX (US); Julmar Shaun S. Toralde, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 205 days.

(21) Appl. No.: 16/435,529

(22) Filed: Jun. 9, 2019

(65) Prior Publication Data

US 2020/0386065 A1 Dec. 10, 2020

(51) Int. Cl.

| | |
|---|---|
| ***E21B 21/00*** | (2006.01) |
| ***E21B 21/08*** | (2006.01) |
| ***E21B 44/00*** | (2006.01) |

(52) U.S. Cl.

CPC ..... *E21B 21/003* (2013.01); *E21B 21/08* (2013.01); *E21B 44/00* (2013.01)

(58) Field of Classification Search

CPC ..... E21B 21/003; E21B 21/08; E21B 21/082; E21B 21/085; E21B 44/00

See application file for complete search history.

(56) References Cited

U.S. PATENT DOCUMENTS

| | | | | |
|---|---|---|---|---|
| 7,237,623 | B2 | 7/2007 | Hannegan | |
| 2009/0194330 | A1* | 8/2009 | Gray | E21B 21/00 175/24 |
| 2016/0097270 | A1* | 4/2016 | Pobedinski | E21B 44/00 700/275 |

(Continued)

FOREIGN PATENT DOCUMENTS

WO 2017195175 A2 11/2017

OTHER PUBLICATIONS

Ezer, E. et al., "Light annular mud cap drilling, downhole isolation valve help to drill fractured gas reservoir in Indonesia," Innovating While Drilling, Mar. 10, 2017, 4-pgs.

(Continued)

*Primary Examiner* — Michael R Wills, III

(74) *Attorney, Agent, or Firm* — Blank Rome LLP

(57) ABSTRACT

For a wellbore drilled in a low or subnormal pressure reservoirs, a static loss rate of drilling fluid is monitored within a limit of a drilling rate. In reaching the limit, the annulus is closed off to returns using a rotating control device, or the annulus may remain open to the atmosphere at surface. Operations may not be able to keep the annulus filled with a mud cap so pressurized mud cap drilling cannot be sustained. Instead, an initial fluid level of the mud cap is defined in the annulus. Drilling the wellbore with the mud cap then involves: pumping a sacrificial fluid through the drillstring without returns to surface through the annulus, and monitoring the initial fluid level in the annulus to detect a change. Monitoring uses downhole instrumentation to (Continued)

measure pressure, temperature, and gas level of the mud cap. In response to the detected change, the drilling can be further controlled, including stopping the drilling, turning off pumps, and possibly bullheading the well.

23 Claims, 5 Drawing Sheets

(56) References Cited

U.S. PATENT DOCUMENTS

| | | | | |
|---|---|---|---|---|
| 2017/0122046 | A1 | 5/2017 | Vavik | |
| 2018/0003023 | A1 | 1/2018 | Couturier et al. | |
| 2019/0145198 | A1 | 5/2019 | Fossli | |
| 2019/0145202 | A1 | 5/2019 | Vavik | |
| 2019/0178073 | A1* | 6/2019 | Boone | E21B 44/00 |
| 2019/0226290 | A1* | 7/2019 | Santos | E21B 21/106 |

OTHER PUBLICATIONS

Weatherford, "DDV(R) Downhole Deployment Valve," Brochure, copyright 2012, 12-pgs.

Karnugroho, A., "Pressurized Mud Cap Drilling for Premier Oil," Presentation, Jan. 9, 2013.

Runtuwene, M. et al., "Pressurized Mud Cap Drilling Drastically Reduces Non-Productive Time in Soka Field, South Sumatera," SPE/IADC 125311, Oct. 26-68, 2009.

Sweep, M.N. et al, Closed Hole Circulation Drilling: Case Study of Drilling a High-Pressure Fractured Reservoir, SPE-79850-MS, Feb. 19-21, 2003.

Hannegan, D. et al., "Managed Pressure Drilling," SPE 2006-2007 Distinguished Lecturer Series, 36-pgs.

International Search Report issued in co-pending PCT Application No. PCT/US2020/035892, dated Aug. 17, 2020, 6 pages.

Al-Amri, Khalifah, et al., Implementing the pressurized mud cap technique to drilling through total loss zones: a way to improve well control while drilling the reservoir in oil well re-entries, SPE/IADC-178218-MS, Jan. 26, 2016, pp. 1-9, United Arab Emirates.

Toralde, Julmar Shaun Sadicon, JPT Retrofitting MPD systems to deepwater rigs aids drilling, efficiency, and process safety, Weatherford SPE, Feb. 1, 2017, pp. 1-11, vol. 69, Issue 2.

Amanbayev, Yerlan, et al., Successful implementation of PMCD technology in kazakhstan, SPE-1919513-18RPTC-MS, Oct. 15, 2018, pp. 1-10, Russia.

* cited by examiner

CLOSED HOLE CIRCULATION DRILLING WITH CONTINUOUS DOWNHOLE MONITORING

BACKGROUND OF THE DISCLOSURE

In conventional drilling practices, drilling fluid is pumped down a drilling string, and returns are brought to the surface via the annulus of the borehole. The hydrostatic column in the annulus is controlled to handle fluid losses to the formation and to handle fluid influxes from the formation.

Some reservoirs are located in carbonate formations, which are severely fractured with natural fractures, karsts, vugs, or caves. These carbonate reservoirs make up about 40% of all global reservoirs and make up approximately 70% of worldwide oil and gas reserves. Due to their prevalence, operators seek ways to drill to target depths in these naturally-fractured carbonate formations. Unfortunately, well control can be complicated when drilling in these carbonate formations because the fractures in the formations can cause severe loss of circulation followed by fluid influx.

Currently, operators use mud-cap drilling (MCD) to drill in carbonate formations and try to keep up with the loss of circulation to the formation. This practice may not be feasible in some situations and cannot be performed in certain areas. There are several forms of mud cap drilling, including Pressurized Mud Cap Drilling (PMCD) also known as Closed Hole Circulation Drilling (CHCD) and Floating Mud Cap Drilling (FMCD).

Pressurized Mud Cap Drilling (PMCD) is a drilling technique used to drill without returns. An example implementation of Pressurized Mud Cap Drilling (PMCD) is disclosed in U.S. Pat. No. 7,237,623, which is incorporated herein by reference. Floating Mud Cap Drilling (FMCD) is another drilling technique used to drill without returns. Sacrificial fluid is continuously pumped down the drillstring and the annulus to prevent formation fluid from migrating to the surface.

In pressurized mud cap drilling, a rotating control device is used while drilling the wellbore and pumping a sacrificial fluid (e.g., water) down the drillpipe. At the same time, a pressurized mud-cap of weighted oil-based mud (OBM) is kept in the annulus to control possible fluid influx.

In general, mud cap drilling allows everything pumped into the wellbore along with drilling cuttings to be injected into the open-hole formation, while a fluid column of a Light Annular Mud (LAM) cap is maintained above the open-hole formation. Additional fluid can be periodically added into the annulus to control the surface back pressure within the operating limits of a rotating control device and/or a riser of the drilling system. In this way, the mud cap maintained in the annulus of the wellbore during drilling can stabilize the borehole and control the well.

Briefly, FIG. 1 illustrates a wellbore 10 being drilled using pressurized mud cap drilling according to the prior art. A drilling system 20 has a drilling string 22 having a float valve 24 and a bottom hole assembly 26. The system 20 drills in an open hole 14 of the wellbore 10. The bottom hole assembly 26 has reached a total loss zone 16 (a.k.a. theft zone) having natural fracture(s) 18. The annulus 12 of the wellbore 10 is closed off from surface using a rotating control device 28. In this way, no returns are brought to surface.

Instead, a sacrificial fluid 32 is pumped down the drillstring 22, and a mud cap 30 is placed in the annulus 12 surrounding the drillstring 22. The float valve 24 prevents fluid flow back up the drillstring 22, such as during connections of drillpipe. The mud cap 30 caps off the open hole 14 and prevents the flow of returns upwards through the annulus 12. Consequently, the returns and any cuttings flow into the formation at the loss circulation zone 16 having the natural fracture(s) 18.

In the pressurized mud cap drilling (PMCD), pressure management is achieved using the pump rates of the sacrificial fluid 32 drilling system 20. The light annular fluid for the mud cap 30 is pumped at a rate that overcomes gas/fluid migration rate down the annulus 12 at just below reservoir pressure to maintain the hole filled and to prevent annular gas migration. However, the sacrificial fluid (e.g., water) is pumped down the drillstring 22 at high pump rates. Consequently, the mud cap 30 increases the bottomhole pressure, while the sacrificial fluid 32 pumped down the drillstring 22 and into the open hole 14 is lost to the theft zone 16. In this way, annular backpressure can be used to balance the reservoir pressure and maintain system balance.

The light annular fluid for the mud cap 30 has a mud weight that is less than a mud weight of the formation fluid in the open hole 14. (As is known, mud weight is the mass per unit volume for a fluid and can be given as mass pounds (lbm) per gallon (ppg). A typical mud weight of the light annular mud may be about 10-ppg (pounds per gallon). As is known, the hydrostatic pressure produced by a column of mud cap 30 in the wellbore annulus 12 is a product of the pressure gradient of the fluid used and the vertical height of the fluid column. The pressure gradient of the fluid is typically given as a unit pressure per unit height (e.g., psi per foot) and is converted from the mud weight of the fluid, which is typically given in pounds-per-gallon, by a conversion factor (e.g., 1 psi per foot equals 19.25 pounds per gallon).

Although lower mud weights are possible, the lower weight fluids may require complex chemistries and additives that may not always be available on site or may not be feasible for use in a given implementation. Accordingly, a conventional light annular fluid of about 10-ppg can be used for open holes that have weights that are only slightly higher (e.g., 10.2-ppg).

To maintain the balance, operators look for a measurable pressure at the rotating control device 28 while pumping the sacrificial fluid 32 down the drillstring 22. As the pressurized mud cap drilling continues, the pressure value at the rotating control device 28 is monitored to maintain a reading within a desired threshold while the annulus 12 is kept full with the mud cap 30 of light annular mud. This allows operators to monitor the annular backpressure used to balance the reservoir pressure and maintain system balance.

Although mud cap drilling may be effective, most of the major carbonate reservoirs where it can be used are approaching their depletion phases. Once depleted, the reservoir pressure cannot even hold a mud column used in mud cap drilling. For example, a relatively depleted reservoir may have a reservoir pressure associated with a pressure gradient from a mud weight of less than 8.6-ppg. Application of pressurized mud cap drilling may therefore no longer be feasible because the reservoir pressure cannot hold the hydrostatic pressure of a column of the lightest available base fluid for the light annulus mud (LAM) in the mud cap 30.

For instance, the mud weight of sea water is approximately 8.56-ppg, while the mud weight of fresh water is about 8.33-ppg. In many cases, the lightest mud available at a drill site without expensive chemistry and additives may have a mud weight of about 8.0-ppg. In other words, the open hole 14 may have a theft zone 16 with a formation pressure associated with a mud weight less than 8.6-ppg (the mud weight of seawater) so that pressurized mud cap drilling with a mud cap of lighter density fluid may not be possible or practical. Therefore, operators need a new solution to drill low or subnormal pressure wells found in relatively depleted reservoirs.

The subject matter of the present disclosure is directed to overcoming, or at least reducing the effects of, one or more of the problems set forth above.

SUMMARY OF THE DISCLOSURE

A method of drilling a wellbore in a formation of a reservoir is disclosed herein. The reservoir may be a low or subnormal pressure reservoir.

In the method, instrumentation is associated with casing disposed in the wellbore. An open hole section of the wellbore is drilled, in a first stage, in the formation for an extent beyond the casing by pumping drilling fluid at a drilling rate through a drillstring and allowing returns of the drilling fluid to surface through an annulus between the wellbore and the drillstring. During the first stage of drilling, a static loss rate of the drilling fluid to the formation is detected to reach within a loss circulation limit of the drilling rate. In response to the detection, the annulus of the wellbore is filled with a mud cap of annulus fluid, and an initial fluid level of the mud cap is defined in the annulus.

The open hole section of the wellbore is drilled, in a second stage, in the formation for a subsequent extent beyond the casing while the annulus is filled with the mud cap by: pumping a sacrificial fluid through the drillstring without returns to surface through the annulus, and monitoring the initial fluid level of the mud cap in the annulus using the instrumentation to detect a change. The drilling is then controlled in response to the detected change.

To detect that the static loss rate of the drilling fluid reaches within the loss circulation limit of the drilling rate, the method can detect that the static loss rate of the drilling fluid reaches within approximately half of the drilling rate.

According to one arrangement of the method, various steps can be performed before filling the annulus of the wellbore with the mud cap of the annulus fluid in response to the detection. In particular, the method can comprise closing off the annulus to returns with a flow control device. For example, a rotating control device can be installed that isolates the annulus in the wellbore from the surface.

With the annulus closed off, filling the annulus with the mud cap can thereby comprise filling the annulus with the mud cap up to the flow control device. The method can then further comprise the step of drilling in an intermediate stage, after the first stage but before the second stage, by keeping the annulus filled with the mud cap up to the flow control device before performing the step of defining the initial fluid level of the mud cap in the annulus below the flow control device. Keeping the annulus filled with the mud cap up to the flow control device in the intermediate stage may involve maintaining a pressure of the mud cap in the annulus at the flow control device.

At some point in this intermediate stage, a determination can be made that the annulus cannot be kept filled with the mud cap up to the flow control device. The drilling is stopped in the intermediate stage, and the mud cap in the annulus is allowed to balance with the reservoir pressure to define the initial fluid level of the mud cap in the annulus below the flow control device. The second stage discussed previously can then follow in the method given the defined initial fluid level.

According to another arrangement of the method, filling the annulus and defining the initial fluid level can comprise: filling the annulus with the annulus fluid; determining that the annulus cannot be kept filled with the annulus fluid; and allowing the annulus fluid in the annulus to balance with the reservoir pressure to define the initial fluid level of the mud cap in the annulus. For example, in determining that the annulus cannot be kept filled with the annulus fluid, a determination can be made (i) that the wellbore cannot be kept full using a lightest one of the annulus fluid available at a rig site, and/or (ii) that a pump rate for pumping the sacrificial fluid exceeds a pump rate limit.

To allow the annulus fluid in the annulus to balance with the reservoir pressure, the pumping of the sacrificial fluid can be stopped, a current level of the annulus fluid can be allowed to drop in the wellbore until stabilized. Stabilization can be established by: measuring a pressure of the annulus fluid in the annulus until the pressure stabilizes to within a pressure margin; and/or monitoring the current level until the current level stabilizes to within a level margin.

In providing the instrumentation associated with the casing, the instrumentation can be provided as part of an isolation valve disposed on the casing in the wellbore. The instrumentation can comprise a pressure sensor measuring an annulus pressure at a depth in the wellbore, the measured pressure being used to determine the initial fluid level of the mud cap in the annulus of the wellbore.

Depending on the behavior and the detected change, the control of drilling can take a number of forms. In one form of control, a determination can be made that the detected change falls within a threshold. The drilling of the wellbore can be continued by pumping the sacrificial fluid through the drillstring without the returns to surface through the annulus, and the method can return to monitoring the initial fluid level in the annulus to detect a subsequent change.

In another form of control, the drilling can be stopped, the pumping of the sacrificial fluid down the drillstring can be turned off.

In yet another form of control, a determination can be made that the detected change comprises an increase of the mud cap from the initial fluid level by detecting an increase in pressure measured at a depth in the annulus, and a determination can be made that the pressure measured at the depth in the annulus stops increasing and then decreases. The method can then convert from drilling the wellbore with the mud cap to drilling a further extent of the wellbore with a different drilling procedure.

In another form of control, a determination can be made that the detected change comprises an increase of the mud cap from the initial fluid level by detecting an increase in pressure measured at a depth in the annulus, and a determination can be made that the pressure measured at the depth in the annulus stops increasing but does not decrease. The method can then re-evaluate the initial fluid level of the mud cap and commence the drilling of a further extent of the wellbore with the mud cap at the re-evaluated fluid level.

In yet another form of control, a determination can be made that the detected change comprises an increase of the mud cap from the initial fluid level, and a determination can be made that pressure measured in the annulus continues increasing. The method can then involve bullheading the wellbore.

In still another form of control, a determination can be made that the detected change comprises a decrease of the mud cap from the initial fluid level by detecting a decrease in pressure measured at a depth in the annulus, and the method may involve bullheading the wellbore.

In another form of control, a determination can be made that the detected change comprises an increase of the mud cap from the initial fluid level. The method can measure for a temperature change in the annulus fluid at a depth in the annulus indicative of migration of formation gas in the mud cap; and the wellbore can be bullheaded in response to the measured temperature change indicative of the formation gas migration in the mud cap.

In yet another form of control, a determination can be made that the detected change comprises an increase of the mud cap from the initial fluid level. The method can measure for a presence of a gas in the annular fluid at a depth in the annulus indicative of migration of formation gas in the mud cap; and the wellbore can be bullheaded in response to the measured presence of the gas indicative of the formation gas migration in the mud cap.

According to the present disclosure, a programmable storage device has program instructions stored thereon for causing a programmable control device to perform a method of drilling a wellbore in a formation of a reservoir according to any of the steps described above.

A system is disclosed herein for drilling a wellbore in a formation of a reservoir. The system comprises instrumentation, fluid handling equipment, and processing equipment. The instrumentation is associated with casing disposed in the wellbore and is configured to measure pressure in the wellbore. The fluid handling equipment is configured to handle fluid in a drillstring in the wellbore and in an annulus between the drillstring and the wellbore. The handled fluid includes drilling fluid, returns, annulus fluid, and sacrificial fluid.

The programmable control device is communicatively coupled to the instrumentation and the fluid handling equipment. The programmable control device is configured to: pump the drilling fluid at a drilling rate through the drillstring and allow the returns to the surface through the annulus to drill an open hole section of the wellbore for an extent in the formation in a first stage; detect during the drilling in the first stage that a static loss rate of the drilling fluid reaches within a loss circulation limit of the drilling rate; in response to the detection, fill the annulus of the wellbore with a mud cap of the annulus fluid, and define an initial fluid level of the mud cap in the annulus; pump the sacrificial fluid through the drillstring without the returns to the surface through the annulus to drill the open hole section of the wellbore in a second stage for a subsequent extent beyond the casing while the annulus is filled with the mud cap; monitor the initial fluid level of the mud cap in the annulus using the instrumentation to detect a change; and control the drilling in response to the detected change.

The foregoing summary is not intended to summarize each potential embodiment or every aspect of the present disclosure.

DETAILED DESCRIPTION OF THE DISCLOSURE

Figure 1:
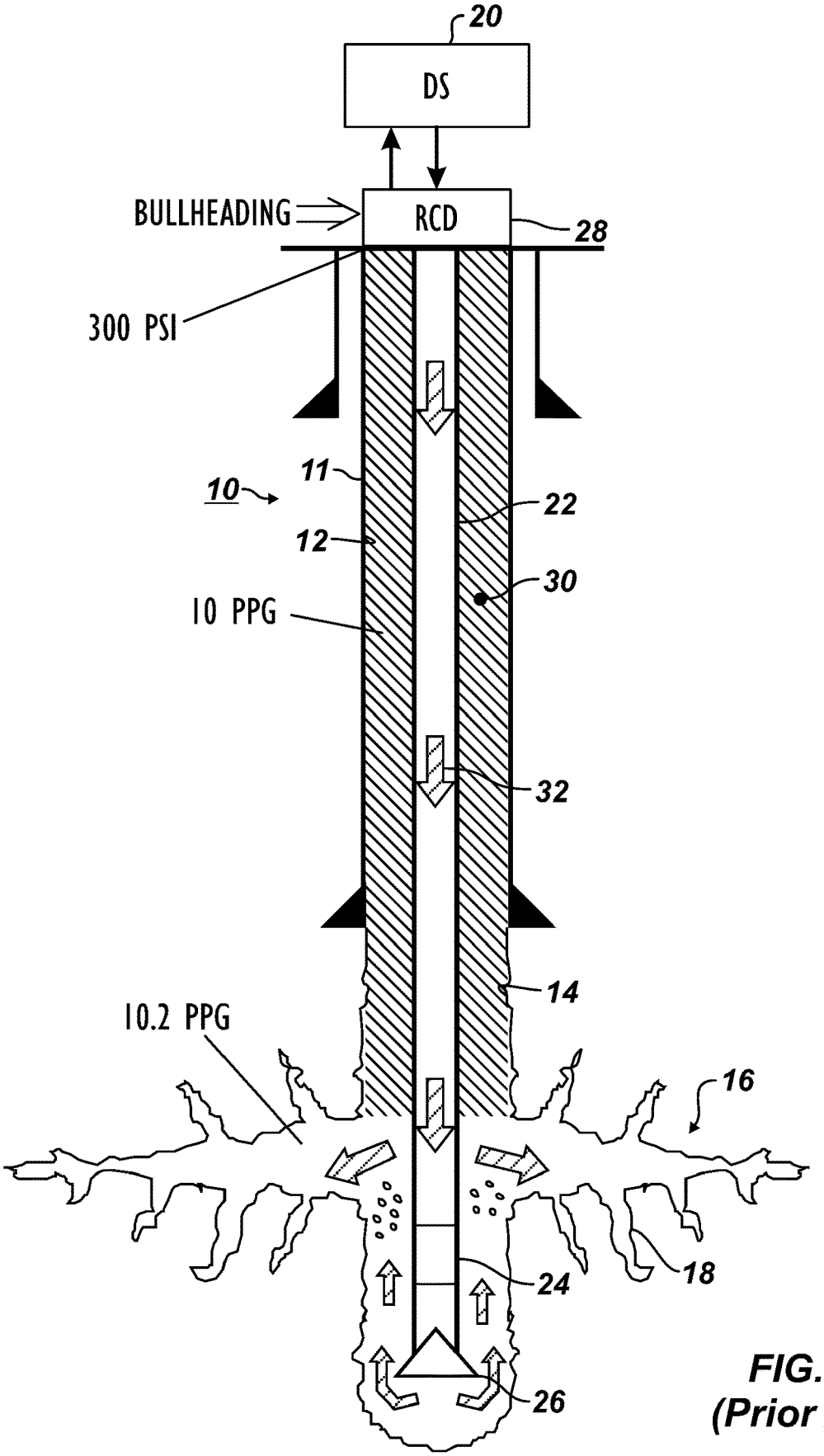
FIG. 1 (Prior Art)
FIG. 1 illustrates a wellbore being drilled using pressurized mud cap drilling according to the prior art.
Figure 2A:
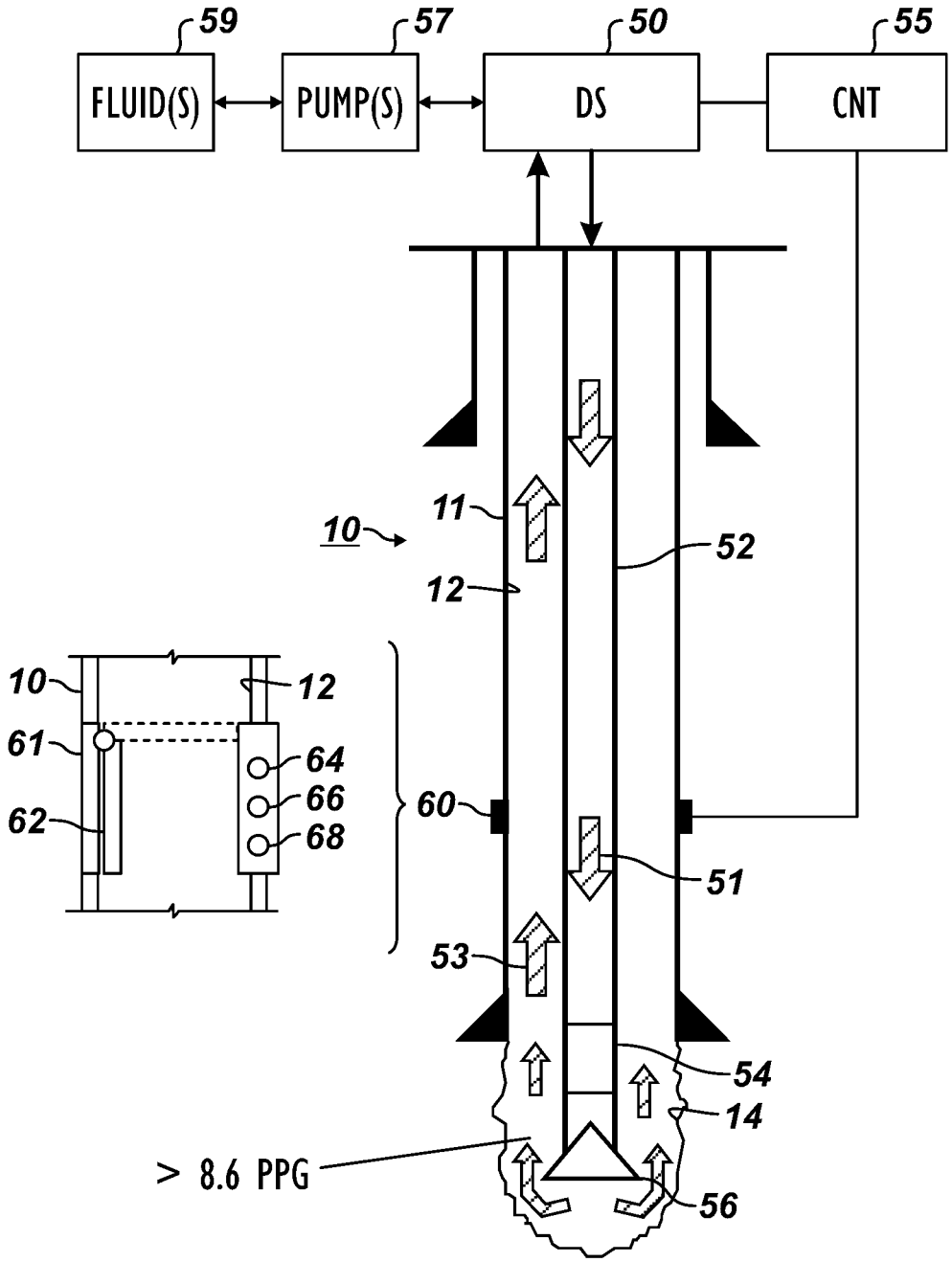
FIG. 2A illustrates a wellbore being drilled in a first stage of a process of closed hole circulation drilling with continuous downhole monitoring according to the present disclosure.

FIG. 2A illustrate a wellbore 10 being drilled in an initial stage of a process of closed hole circulation drilling with continuous downhole monitoring according to the present disclosure. The wellbore 10 is being drilled using a drilling system 50 having a drilling string 52, a float valve 54, and a bottom hole assembly 56. The system 50 drills with the bottom hole assembly 56 in an open hole section 14 of the wellbore 10, and the float valve 54 prevents fluid flow back up the drillstring 22, such as during connections of drillpipe.

Overall, the drilling system 50 may be an offshore system or a land-based system. As an offshore system, the drilling system 50 may be implemented on a floating platform or mobile offshore drilling unit (MODU) and may use a riser (not shown) connected to a subsea Blow-Out-Preventer on a wellhead (not shown) at the sea floor. Overall, the drilling system 50 can include any of the conventional equipment of a rig assembly for running, rotating, and tripping the drillstring 52 and for handling fluid.

In general, the drilling system 50 includes fluid handling equipment to handle fluid in the drillstring 52 and in the annulus 12 between the drillstring 52 and the wellbore. For example, one or more pumps 57 are operable to pump fluid from one or more sources 59 into the drilling string 52 and the annulus 12. As discussed below, the fluid sources 59 at least include a sacrificial fluid and a drilling fluid. Instrumentation 60 associated with the casing 11 disposed in the wellbore 10 is configured to measure parameters in the annulus 12. The instrumentation 60 at least includes one or more pressure sensor s64 that can measure pressure of the fluid in the annulus 12, as discussed below.

In the initial stage of FIG. 2A, the system 50 may be drilling the wellbore 10 in a conventional manner. Depending on the drilling environment, for example, the system 50 may or may not include a flow control device (not shown in FIG. 2A) to isolate the annulus 12 from surface. As discussed below with reference to FIGS. 2B-2C, however, the system 50 can be switched from a conventional arrangement in FIG. 2A to an arrangement having a flow control device in other stages of drilling. The flow control device can include a rotating control device 58 capable of isolating the annulus 12 of the wellbore 10 around the drillstring 22 from the surface. The rotating control device 58 or other flow control may also allow for drilling fluid to be injected, pumped, and the like into the annulus 12 from the surface equipment. In other arrangements, a rotating control device 58 may not be used, and the wellbore 10 may be closed in other known ways. Further still, the wellbore 10 may not need to be closed in this manner with the flow control device 58 and may remain open to atmosphere at surface. Flow returns to the surface can be stopped using conventional techniques.

Finally, a programmable control device or control 55 is communicatively coupled to the drilling system 50 and to the instrumentation 60. The control 55 can include manual and automated interfaces for conducing drilling operations as disclosed herein and can be implemented using know components, such as processing equipment, user interface, machine interfaces, etc.

As shown in the detail of FIG. 2A, the instrumentation 60 includes one or more pressure sensors 64, one or more temperature sensors 66, and one or more gas sensors 68. These sensors 64, 66, and 68 can communicate with the control 55 of the drilling system 50 using known communication techniques, such as communication lines disposed along the casing 11 of the wellbore 10. The pressure sensors 64 and the temperature sensors 66 can use quartz gauges typically used for downhole measurements. The gas sensors 68 can monitor for gas indicative of gas migration. These gases can include H2S, CO2, and other hazardous gases. The sensors 68 can be downhole fluid chromatography sensors or any suitable sensors.

As shown, the instrumentation 60 of the drilling system 50 can include a downhole valve 61 (e.g., casing valve or retrievable valve) disposed on/in the casing 11 of the cased section of the wellbore 10. The sensors 64, 66, 68 can be part of such a downhole valve 61. Briefly, the downhole valve 61 includes an isolation valve 62, such as a flapper valve, that can be closed in a number of ways to close off the wellbore 10 below the valve 62. For example, the isolation valve 62 may be opened/closed using hydraulics communicated with control line(s) or umbilicals from surface. In other ways, the valve 62 may be opened/closed without an umbilical and may instead be operated using telemetry or using Radio Frequency Identification tags and a receiver.

Although the instrumentation 60 is shown at one location/depth in the wellbore 10 and incorporated as part of a downhole valve 61, the drilling system 50 can include instrumentation at multiple locations/depths in the wellbore 10. Any of these multiple locations may include any one or more of the sensors 64, 66, 68 associated with the instrumentation 60 for providing different measurement points along the wellbore 10.

In this initial stage of the drilling process of FIG. 2A, the drilling system 50 pumps drilling fluid 51 down the drillstring 52 and receives returns 53 that flow up the annulus 12 to the surface. This conventional drilling can be continued in the formation as long as possible and at least until a total loss or theft zone is expected or encountered. Such a theft zone may be associated with a reservoir having extensive fractures/vugs. As noted herein, a total loss or theft zone constitutes a zone of high porosity where lost circulation occurs. A considerable amount of the drilling fluid 52 pumped down the drilling string 52 would be lost to the theft zone, reducing the returns 53 to the surface. This could then make well control more difficult.

Figure 2B:
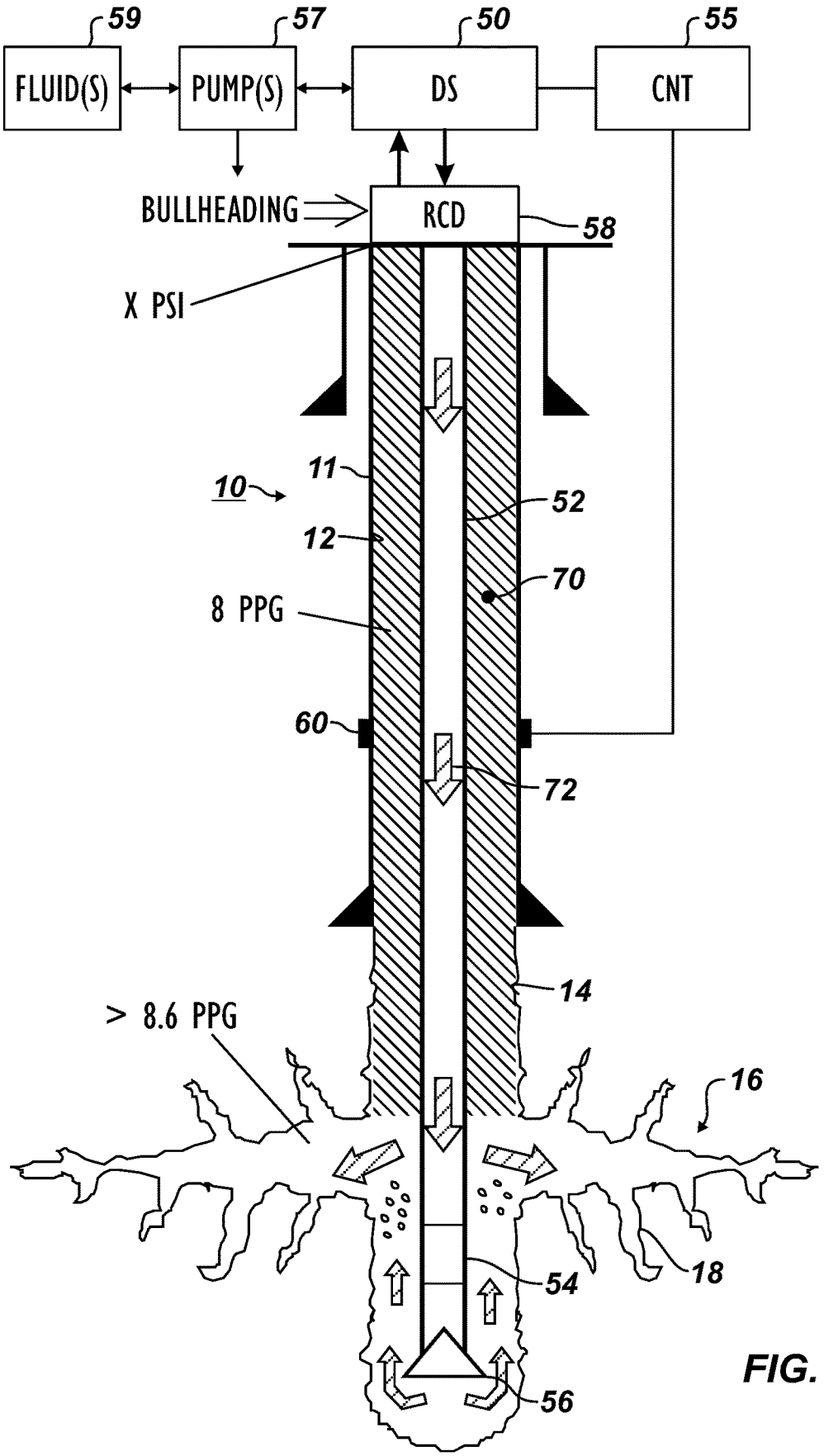
FIG. 2B illustrates the wellbore being drilled in a second stage of the process according to the present disclosure.
Figure 2C:
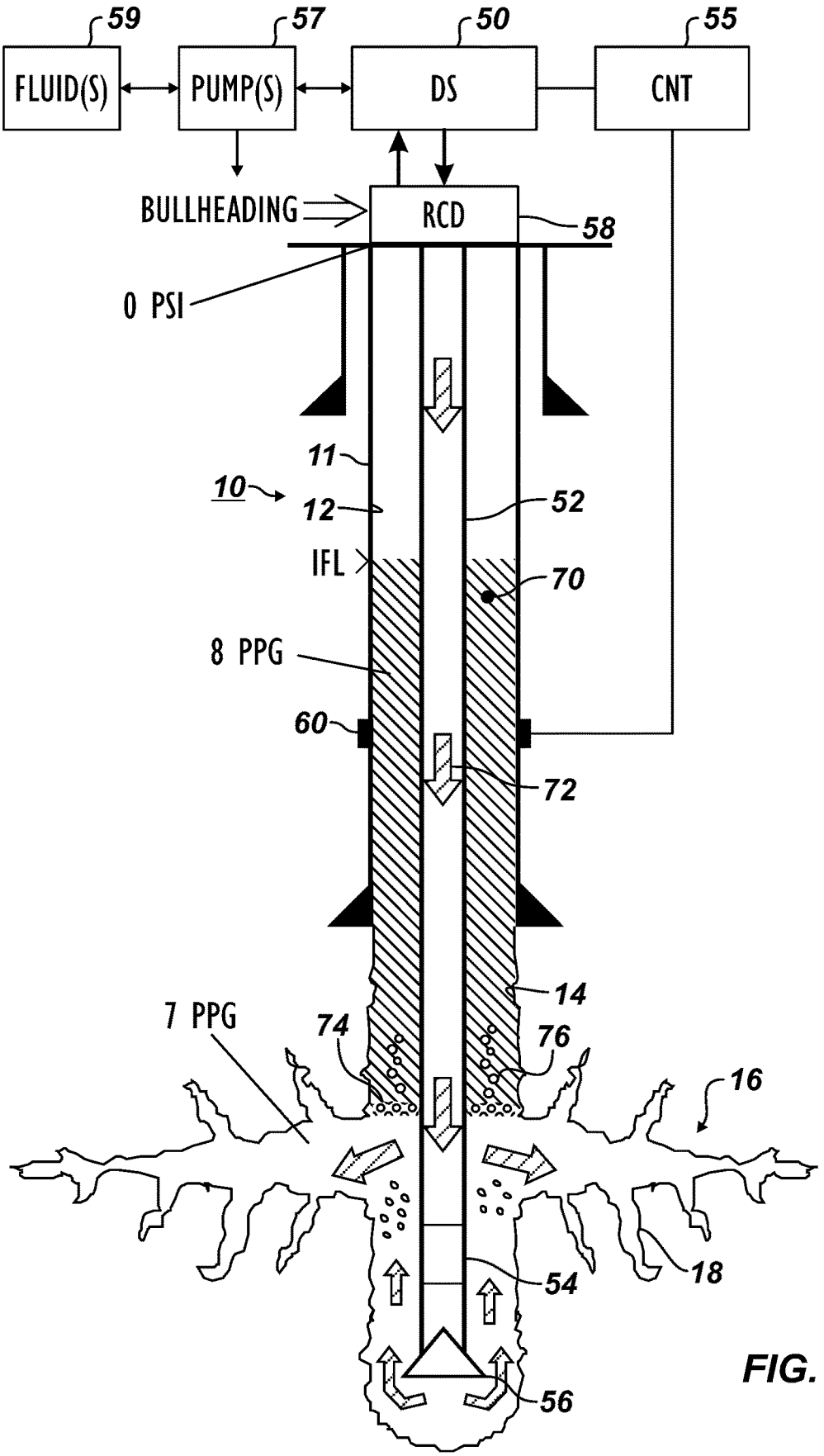
FIG. 2C illustrates the wellbore being drilled in a third stage of the process according to the present disclosure.
Figure 3:
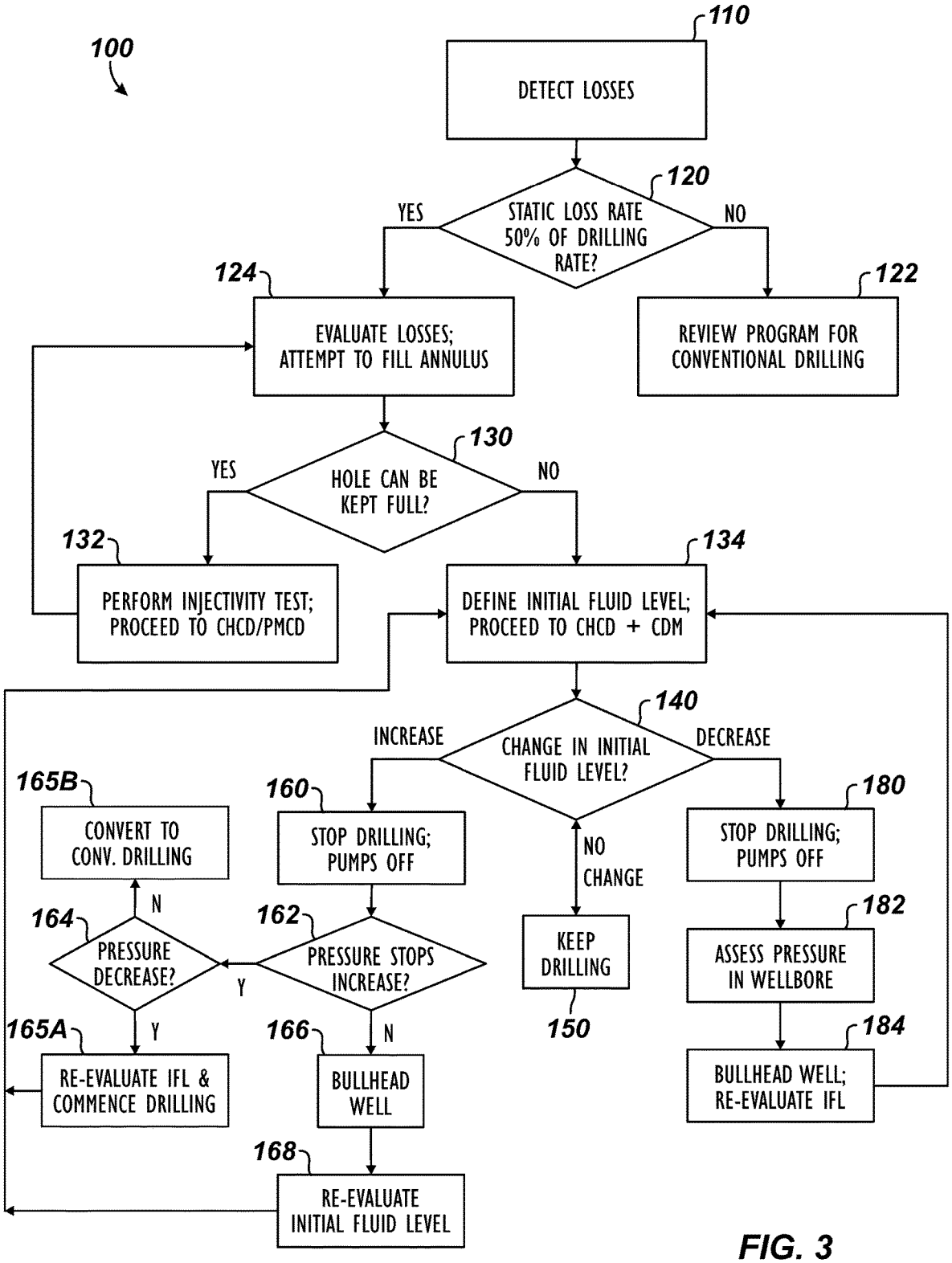
FIG. 3 illustrates a process of closed hole circulation drilling with continuous downhole monitoring of the present disclosure.

When a theft zone is expected or encountered, operations proceed to a process of closed hole circulation drilling with continuous downhole monitoring of the present disclosure. To that end, FIG. 2B illustrates the wellbore 10 being drilled in a second stage of the disclosed process, while FIG. 2C illustrates the wellbore 10 being drilled in a third stage of the disclosed process should the process fail to maintain the steps in the first stage. FIG. 3 illustrates the process 100 of closed hole circulation drilling with continuous downhole monitoring of the present disclosure.

During the process 100, the drilling system 50 detects losses during the conventional drilling of the initial stage in FIG. 2A (Block 110). As is customary, not all losses may be of particular concern and may be handled by the current drilling technique. Therefore, a comparison is made to determine if the static loss rate is at least within some limit of the current drilling rate (Decision 120). For example, the static loss rate may be monitored and handled with conventional drilling techniques until the static loss rate reaches within a limit of about 50% (i.e., half) of the current drilling rate. The value of the limit may depend on the drilling system 50, the formation being drilled, and other factors consistent with a given implementation.

If the static loss rate has not reached the limit (No at Decision 120), then the current regime for the conventional drilling of the wellbore 10 may be reviewed to provide better well control. For example, the control 55 may continue with the conventional drilling of the wellbore 10 with the system 50 in FIG. 2A, but the drilling may be modified using conventional adjustments, such as introducing lost circulation material (LCM) into the wellbore 10.

Knowledge of the formation may indicate when theft zones may be encountered during drilling, and the process 100 can be converted before. In any event, if the static loss rate is at least within the limit (e.g., 50%) of the drilling rate (Yes at Decision 120), then the control 55 evaluates the reasons for the losses. For example, operations may determine that a total loss or theft zone having natural fractures may have been encountered during the conventional drilling of the formation so that mud cap drilling needs to be implemented.

The theft zone when drilling conventionally can cause undesirable excessive or total loss of circulation, differentially stuck pipe, and resulting well control issues. Switching to mud cap drilling as shown in FIG. 2B allows the drilling system 50 to take advantage of the presence of the theft zone 16. Because the theft zone 16 is of high porosity and is relatively depleted, the theft zone 16 offers an ideal depository for clear, non-invasive fluids and cuttings during drilling. To that end, the process 100 commences with pressurized mud cap drilling (PMCD) to achieve pressure management of the wellbore 10 using a mud cap and pump rates.

At this point, the process 100 initiates a pressurized mud cap drilling regime (Block 124). As shown in FIG. 2B, operations fill the wellbore 10 with a light oil-based fluid and water to fill the open hole 14 and the annulus 12 to commence with drilling. As a result, a mud cap 70 is placed in the annulus 12 surrounding the drillstring 52 to cap off returns in the open hole 14 from flowing upwards through the annulus 12. To do this, a viscous fluid, such as a light annular fluid, can be pumped at a rate that overcomes gas/fluid migration rate down the annulus 12 at just below reservoir pressure to maintain the hole filled and to prevent annular gas migration from the theft zone 16.

A surface (ball) valve (not shown) can be used at surface before pipe connections to isolate the new pipe stand, and the float valve 54 can prevent fluid from the wellbore from entering the drillstring 52 during pipe connections. A flow control device 58 can be installed in the drilling system 50 to isolate the annulus 12 of the wellbore 10 from the surface. In the pressurized mud cap drilling regime of FIG. 2B, the annulus 12 can be closed, for example, by a rotating control device 58. As is customary, a flow spool or other component below the rotating control device 58 may allow for introduction of the mud cap 70.

Either way, no returns are brought to surface during the pressurized mud cap drilling. Instead, a sacrificial or disposable drilling fluid 72 (e.g., water) is pumped down the drillstring 22. An interface in the annulus 12 is maintained between crude oil, the sacrificial fluid 72, and the annular fluid of the mud cap 70, and the sacrificial fluid 72 and cuttings are lost to the formation fractures 18 in the theft zone 16. The resulting annular backpressure is used to balance the reservoir pressure and maintain system balance.

As noted above, the mud cap 70 is used to increase the bottomhole pressure by forming a column of heavier and often viscosified mud in the annulus 12 of the wellbore 10.

The column is shorter than the total vertical depth (TVD) of the annulus 12, and the size of the mud cap 70 is based on how long the mud cap 70 needs to be, the mud weight of the fluid in the mud cap 70, and the amount of extra pressure that is needed to balance or control the well.

The weight for the light annular mud in the mud cap 70 is selected so that it is lower than the pressure gradient of the theft zone 16. This helps avoid further loss of circulation. Some other factors of concern include the resistance of the mud in the mud cap 70 to contamination in the wellbore 10, the mud's viscosity, and the mud's resistance to being broken up by flow or circulation.

Any gas migration into the mud cap 70 in the annulus 12 can be countered by bullheading the wellbore 10. Bullheading involves forcibly pumping the fluids in the wellbore 10 into the formation. This may be done by pumping into the annulus 12 from the surface. Typically, the volume, the time interval, and the rate for bullheading are calculated based on current conditions.

In keeping the annulus 12 filled with the mud cap 70, a decision is made in the process 100 to determine if the wellbore 10 can be kept full (Decision 130). If the wellbore 10 can be kept full with the mud cap 70, then operations perform an injectivity test and continue with the mud cap drilling technique, such as Closed Hole Circulation Drilling (CHCD) or Pressurized Mud Cap Drilling (PMCD) (Block 132).

The injectivity test involves evaluating losses before making any decision to switch to PMCD/CHCD operation. Briefly, for example, a BOP (not shown) is closed, and the RCD flowline valve is closed for operations to proceed with performing the injectivity test. Operations stop annular fluid injection and determine the initial casing pressure (e.g., 100 psi) from stroke counters or another source. For the test, sacrificial fluid (e.g., seawater) is lined up to the surface pumps, and operations begin injecting the sacrificial fluid down the drillstring 52. The pumping starts at a beginning rate for a period of time (e.g., start at 100 gpm for 2 minutes). The pumping rate is then increased in increments and held for a period at each increment until reaching a maximum drilling rate. For example, the pumping rate can be brought up in 100 gpm increments until reaching 600 gpm, which may be the maximum drilling rate as per the drilling program. The increase at each increment can be held for 2 minutes.

In the meantime, the Stand Pipe Pressure (SPP) and the annular pressure are monitored. If the injectivity test indicates the annular pressure is below a given threshold (e.g., <500 psi), the operations switch drilling to the PMCD mode. By contrast, if the annular pressure exceeds the threshold (e.g., >500 psi), operations resume circulating with conventional drilling fluid and drill ahead, while monitoring losses. The switch to PMCD would then be made once a fracture system is encountered in the wellbore 10 that can handle the injection rate.

Operations continue with the control 55 managing the annular pressure in the wellbore 10 using the pressurized mud cap drilling techniques. As drilling continues, losses may be continually evaluated, and an assessment can be made of maintaining the annulus filled (Block 124).

If the wellbore 10 cannot be kept full (No at Decision 130), then operations switch to using continuous downhole monitoring according to the present disclosure rather than proceeding the pressurized mud cap drilling (Block 134). In particular, for the pressurized mud cap drilling regime to proceed, pressure from the mud cap 70 may be measured at the rotating control device 58 while pumping the sacrificial fluid 72 so the annular backpressure can be maintained on the formation. For example, a reading of annular pressure at the rotating control device 58 may indicate that the wellbore 10 is being kept full with the mud cap 70. As noted previously, the drilling system 50 may not include such a flow control device or a rotating control device 58, and the wellbore 10 may be closed in other known ways.

Further still, the wellbore 10 may not need to be closed in this manner with the flow control device 58 and may remain open to atmosphere at surface. Either way, flow returns are not brought to the surface.

If the level of the mud cap 70 cannot be maintained up to the rotating control device 58, then the pressurized mud cap drilling cannot be sustained. There may be several reasons when the wellbore 10 cannot be kept full. For example, the pump rates for pumping the sacrificial fluid 12 required to sustain the fluid level in the annulus 12 may exceed desired rates that can damage the mud pumps or cause other issues. In fact, the theft zone 16 may have a formation pressure that is below conventionally acceptable levels because the reservoir is in its depletion stage. For this reason, the wellbore 10 may not be kept full with even the lightest available fluid at the rig site.

At this point, operations stop pumping the fluid, let the fluid level in the wellbore 10 drop, and closely monitor the pressure in the annulus 12. In the monitoring, downhole monitoring of the mud cap 70 is provided by the instrumentation 60 (e.g., the downhole valve 61 having the sensors 64, 66, 68). Other forms of instrumentation 60 available in the art could be used. At the beginning when pumping is stopped, the monitored pressure at the instrumentation 60 is expected to decrease at a high rate until it is stabilized (+/−100 psi) when the wellbore 10 is balanced with the reservoir pressure.

As shown in FIG. 2C, the wellbore 10 cannot be kept full so that the level of the mud cap 70 has receded in the annulus 12. As noted herein, the wellbore 10 may not be kept full because the theft zone 16 encountered may have a pressure gradient with formation fluid far below 8.6-ppg. For example, the theft zone 16 may have formation fluid with a weight of 7-ppg, and the lowest available mud weight for the mud cap 70 will likely be higher, such as 8-ppg. Consequently, the level of the mud cap 70 has dropped, resulting in the decrease in monitored pressure at the instrumentation 60. Eventually, balance is reach when the wellbore pressure 10 is balanced with the reservoir pressure.

At this point in the process 100, an initial fluid level (IFL) is defined in the annulus 12 based on the monitored pressure and the fluid in the wellbore 10 (Block 134). As described herein, the initial fluid level (IFL) can constitute a liquid/gas interface level or an elevation of the mud cap 70 used for managing and controlling the formation pressures.

As noted herein, the instrumentation 60, such as in the downhole valve 61, has the one or more pressure sensors 64 for measuring pressure in the annulus 12. The light annular mud used in the mud cap 70 with its known mud weight fills a column in the annulus 12 and produces a calculable pressure at the location of the downhole valve's pressure sensor 64. In this way, the initial fluid level (IFL) of the mud cap 70 in the annulus 12 can be determined based on the measured pressure from the known mud filling a calculable column of the annulus 12.

At this point with the initial fluid level defined, operations proceed with the Closed Hole Circulation Drilling (CHCD) technique combined with continuous downhole monitoring (Block 134). As before, fluid returns are not brought up the annulus to surface. The wellbore 10 can remain closed with the rotating control device 56 (if used) so gasses can be diverted from the rig of the drilling system 50. As noted above, the rotating control device 58 can be used so that the rotating control device 58 also creates a closed system, making it easier to control the well. In other arrangements, the rotating control device 58 may not be used, and the wellbore 10 is closed in other known ways or may remain open to the atmosphere at surface.

Either way, with the mud cap 70 at the initial fluid level (IFL), operations start drilling by pumping scarification fluid 72 and monitoring the pressure at the instrumentation 60. The monitored pressure indicates the initial fluid level (IFL) in the annulus 12 and the corresponding pressure that the mud cap 70 applies to the formation.

An emulsification 74 may develop at the interface between the sacrificial fluid 72, the formation fluid, and the annular mud cap 70. The emulsification 74 can initially keep formation gas 76 from migrating into the mud cap 70. As will be appreciated, significant migration of formation gas 76 in the mud cap 70 would alter the density of the mud cap 70, change the initial fluid level, and undermine the well control provided. As noted below, bullheading the wellbore can be used to counter the gas migration. Because the drilling system 50 can perform continuous operational monitoring and diagnostics, any bullheading of the wellbore 10 is based on the actual behavior of the downhole conditions, rather than just blind bullheading based on the predicted/assumed variables.

Therefore, in addition to monitoring pressure in the annulus 12 to define the initial fluid level of the mud cap 70, temperature in the annulus 13 and H2S/CO2 gas values can be monitored closely at the downhole instrumentation 60 as additional indicators to detect gas migration. Temperature measured at the instrumentation 60 can detect an influx migrating in the mud cap 70 as the influx reaches the instrumentation 60 because the temperature of the influx will be higher than temperature of the bullheaded mud cap 70. This can give an indication of gas migrating from the formation up through the mud cap 70. The gas sensors 68 at the instrumentation 60 can also measure levels of gasses, such as H2S and CO2, as an indication of possible gas migration up the mud cap 70.

With the initial fluid level defined, drilling of the wellbore 10 continues while the drilling system 50 pumps the sacrificial fluid 72 and the control 55 monitors for a change in the initial fluid level (Decision 140). If the pressure measured at the instrumentation 60 shows a stable trend (e.g., +/−50 psi), then operations continue drilling (Block 150). Therefore, by monitoring the pressure, the control 55 continues to monitor the initial fluid level to determine whether there is an increase or a decrease in the fluid level (Decision 140). Should the initial fluid level remain the same +/− a threshold, e.g., 100-ft., then the control 55 keeps drilling (Block 150) and continues monitoring.

However, the level of the mud cap 70 may increase from the Initial Fluid Level (IFL) (Increase at Decision 140) due to a complete formation plug off, an influx/gas stream, or a reservoir pressure increase. This increase of the mud cap 70 from the Initial Fluid Level (IFL) may then decrease due to a partial plug-off of the formation. In general, should an increase be detected by the continuous monitoring, operators stop drilling, turn off the mud pumps 57, and bullhead the well. These steps will be discussed below.

By contrast, the level of the mud cap 70 may decrease from the Initial Fluid Level (IFL) (Decrease at Decision 140) due to an encounter with another fracture/vugs or due to influx/gas streams. The decrease from the Initial Fluid Level (IFL) may then start to increase due the well flowing. In general, should a decrease be detected by the continuous monitoring, operations stop drilling, turn off the mud pumps 57, and assess the situation. These steps will also be discussed below.

As disclosed herein, drilling through a relatively depleted and fractured/vugular reservoir can be achieved while continuously monitoring the fluid level of the mud cap 70 in the annulus 12 with the downhole instrumentation 60 (i.e., one or more downhole sensors or gauges 64, 66, 68 installed in the downhole valve 61). For the monitoring, downhole sensors 64, 66, 68 measure pressure, temperature, gas level, and other variables if needed. Based on the downhole pressure readings, the fluid level of the mud cap 70 is identified using the control 55, which includes a surface processing unit/software program. This allows the mud cap 70 to be constantly monitored to determine changes in its fluid level and to assess the behavior of the well.

For the increase in the level of the mud cap 70 from the Initial Fluid Level (IFL) (Increase at Decision 140), the pressure measured at the downhole instrumentation 60 shows an increasing trend in pressure so that operations stop drilling and turn the pumps 57 off (Block 160). Operations then assess the reasons for the increasing pressure. In particular, if the pressure stops increasing at least within a given time frame (Yes at Decision 162) and subsequently keeps decreasing until a point above the initial fluid level (Yes at Decision 164), the fracture 18 in the formation may have become plugged to some degree but not completely by the cuttings. In this case, operations re-evaluate a new initial fluid level (IFL) for the mud cap 70 in the wellbore 10 (Block 165A) so operations can continue drilling with the continuous monitoring regime under this re-evaluated initial fluid level (Block 134).

If the pressure stops increasing (Yes at Decision 162) without then decreasing (No at Decision 164), the fracture 18 may be plugged significantly, and the wellbore 10 sees the increase in fluid level. Operations can then assess the well condition and may switch back to conventional drilling techniques, to pressurized mud cap drilling, or to resuming the drilling with the continuous monitoring regime (Block 165B).

If the increasing pressure does not stop increasing at least within a given time frame (No at Decision 162), then additional assessment is necessary. If the pressure continues increasing at a high rate, then a large influx from the formation 16 may be expanding in the wellbore 10, thereby pushing up the level of the mud cap 70 and increasing the pressure reading at the instrumentation 60. In addition to the high rate of pressure increase, the instrumentation 60 may measure the temperature potentially increasing and/or the H2S/CO2 levels potentially going up due to gas migration in the mud cap 70. In this case, operations bullhead down the wellbore to pump out the fluids from the wellbore 10 into the formation and replace a mud cap 70 with new fluid (Block 166) and re-evaluation the fluid level to be used (Block 168). Even if the pressure continues increasing at a slow rate (and/or temperature increases and/or the H2S/CO2 levels go up), a gas stream may be pushing the mud level up. The wellbore may need to be bullheaded (Block 166), and the fluid level may need to be reevaluated (Block 168).

If the influx is due to encountering a higher reservoir pressure than encountered at the previous fracture zone 16, then the initial fluid level (IFL) needs to be re-evaluated based on the new reservoir pressure (Block 168) so operations can continue drilling with the continuous monitoring regime under this re-evaluated initial fluid level (Block 134).

By contrast, for the decrease in level of the mud cap 70 from the Initial Fluid Level (IFL) (Decrease at Decision 140), the pressure at the instrumentation 60 may show a decreasing trend so that operations stop drilling and turn the pumps 57 off. Operations then assess the reasons for the decreasing pressure.

The pressure would not be expected to simply continue decreasing. The pressure decrease is expected to stop at some point when a balance is achieved with the reservoir pressure. If the pressure decreases, stops at some point, and then increases, the wellbore has possibly encountered another fractured theft zone. For example, the fractured theft zone may produce a kick or influx due to the loss of the mud cap's hydrostatic head. In this case, operations bullhead the wellbore and re-evaluate the initial fluid level for the mud cap 70 (Block 184).

On the other hand, if the pressure stops decreasing at some point and then increases (and/or temperature increases and/or H2S/CO2 levels go up), then the wellbore may be flowing. In this case, the wellbore needs to be bullheaded, and the IFL needs to be re-evaluated with the new well condition (Block 184).

Throughout the drilling process 100, drilling to a given depth can be completed. A new liner can then be run downhole of the existing casing 11 and cemented in the open hole 14 to isolate the previously drilled zones of the formation. Such a liner can include additional downhole instrumentation 60 according to the present disclosure, and/or any existing instrumentation 60 on/in the previous section of casing 11 can still be used for monitoring the next hole sections. Also, a retrievable downhole valve 61 with the instrumentation 60 can be used on top of the new liner.

Once the recently drilled zones are isolated, deeper zones can then be drilled into the formation according to the techniques of the present disclosure as needed. This process can be repeated as needed until a total depth of the wellbore 10 is reached in the reservoir. Completion operations known in the art can then be performed to prepare the wellbore for production of the hydrocarbons from the reservoir.

Monitoring for gas migration may be difficult if oil-based mud (OBM) is used for the mud cap 70. Therefore, closing the flapper valve 62 of the downhole valve 61 may be performed from time to time to monitor gas migration behavior in the oil-based mud. This step can be included as a part of the procedures during drilling in the continuous monitor mode (Block 134) when the mud cap 70 has oil-based mud.

To close the flapper valve 62, the bottom hole assembly is 56 is positioned above the downhole valve 61, which is then closed by the control 55 using umbilical (hydraulics) or non-umbilical (e.g., RFID). Pressure can be bled off above the closed flapper valve 62, and the wellbore can be monitored to confirm isolation. The instrumentation 60 can then make measurements to detect gas migration using the pressure sensor 64.

For example, the pressure sensor 64 can monitor for an increase in the pressure downhole of the flapper 62 over time until it stabilizes and can estimate a rate of gas migration based on distance between the downhole valve 61 and a loss zone. For example, the pressure at downhole valve 61 may be 3000 psi when the flapper valve 62 is initially closed. The pressure may start increasing until it stabilizes at some level (e.g., 3120 psi). This increase until stabilization would have taken a given amount of time, such as 60 min. In this example, the gas migration rate can be estimated to be about 2 psi/min. Alternatively, it can be assumed that the gas will migrate from the first loss zone to the depth of the control valve 61, and the distance can be used for a rate estimation. For instance, the distance from the first loss zone in the wellbore 10 to the downhole valve 61 may be 1000 ft, and it may have taken 100 min for the monitored pressure at the downhole valve 61 to be stabilized. In this case, the migration rate can be estimated to be 10 ft/min. Or, if gas is already between valves 61, the estimation can use that distance.

This procedure of closing the flapper valve 62 might not be feasible as it requires pulling a few stands of the drillstring 22 out of hole so the valve 62 can be closed to check for gas migration. However, closing the flapper valve 62 can be done once to assess gas migration behavior of the reservoir with either water-based mud (WBM) or oil-based mud (OBM). This assessed behavior would then help to calculate bullheading volume, bullheading time interval, and bullheading rate based on the actual gas migration rate, not based on a predicted rate from simulation software.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

As will be appreciated, teachings of the present disclosure, such as the operational decisions and process steps disclosed above, can be implemented by the control 55 of the drilling system 50 in digital electronic circuitry, computer hardware, computer firmware, computer software, or any combination thereof. Teachings of the present disclosure can be implemented in a programmable storage device (computer program product tangibly embodied in a machine-readable storage device) for execution by a programmable control device or processor (e.g., of the control 55) so that the programmable processor executing program instructions can perform functions of the present disclosure. The teachings of the present disclosure can be implemented advantageously in one or more computer programs that are executable on a programmable system, such as the control 55 of the drilling system 50, including at least one programmable processor coupled to receive data and instructions from, and to transmit data and instructions to, a data storage system, at least one input device, and at least one output device. Storage devices suitable for tangibly embodying computer program instructions and data include all forms of non-volatile memory, including by way of example semiconductor memory devices, such as EPROM, EEPROM, and flash memory devices; magnetic disks such as internal hard disks and removable disks; magneto-optical disks; and CD-ROM disks. Any of the foregoing can be supplemented by, or incorporated in, ASICs (application-specific integrated circuits).

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A method of drilling a wellbore in a formation of a reservoir, the method comprising:

providing instrumentation associated with casing disposed in the wellbore;

drilling, in a first stage, an open hole section of the wellbore in the formation for an extent beyond the casing by pumping drilling fluid at a drilling rate through a drillstring and allowing returns of the drilling fluid to surface through an annulus between the wellbore and the drillstring;

detecting, during the first stage of drilling, that a static loss rate of the drilling fluid to the formation reaches within a loss circulation limit of the drilling rate;

in response to the detection, filling the annulus of the wellbore with a mud cap of annulus fluid, and defining an initial fluid level of the mud cap in the annulus;

drilling, in a second stage, the open hole section of the wellbore in the formation for a subsequent extent beyond the casing while the annulus is filled with the mud cap by: pumping a sacrificial fluid through the drillstring without returns to surface through the annulus, and monitoring the initial fluid level of the mud cap in the annulus using the instrumentation to detect a change; and controlling the drilling in response to the detected change.

2. The method of claim 1, wherein detecting that the static loss rate of the drilling fluid reaches within the loss circulation limit of the drilling rate comprises detecting that the static loss rate of the drilling fluid reaches within approximately half of the drilling rate.

3. The method of claim 1, wherein before filling the annulus of the wellbore with the mud cap of the annulus fluid in response to the detection, the method comprises closing off the annulus to returns with a flow control device, or keeping the annulus open to atmosphere at surface.

4. The method of claim 3, wherein closing off the annulus to the returns with the flow control device comprises installing a rotating control device isolating the annulus in the wellbore from the surface.

5. The method of claim 3, wherein filling the annulus of the wellbore with the mud cap of the annulus fluid comprises filling the annulus with the mud cap up to the flow control device; and wherein the method further comprises the step of drilling in an intermediate stage, after the first stage but before the second stage, by keeping the annulus filled with the mud cap up to the flow control device before performing the step of defining the initial fluid level of the mud cap in the annulus below the flow control device.

6. The method of claim 5, wherein keeping the annulus filled with the mud cap up to the flow control device in the intermediate stage comprises maintaining a pressure of the mud cap in the annulus at the flow control device.

7. The method of claim 6, further comprising:

determining that the annulus cannot be kept filled with the mud cap up to the flow control device;

stopping the drilling in the intermediate stage; and allowing the mud cap in the annulus to balance with the reservoir pressure to define the initial fluid level of the mud cap in the annulus below the flow control device.

8. The method of claim 1, wherein filling the annulus and defining the initial fluid level comprises:

filling the annulus with the annulus fluid;

determining that the annulus cannot be kept filled with the annulus fluid; and allowing the annulus fluid in the annulus to balance with the reservoir pressure to define the initial fluid level of the mud cap in the annulus.

9. The method of claim 8, wherein determining that the annulus cannot be kept filled with the annulus fluid comprises:

determining that the wellbore cannot be kept full using a lightest one of the annulus fluid available at a rig site; and/or determining that a pump rate for pumping the sacrificial fluid exceeds a pump rate limit.

10. The method of claim 8, wherein allowing the annulus fluid in the annulus to balance with the reservoir pressure comprises stopping the pumping of the sacrificial fluid; and letting a current level of the annulus fluid drop in the wellbore until stabilized.

11. The method of claim 10, wherein letting the current level of the annulus fluid drop in the wellbore until stabilized comprises:

measuring a pressure of the annulus fluid in the annulus until the pressure stabilizes to within a pressure margin; and/or monitoring the current level until the current level stabilizes to within a level margin.

12. The method of claim 1, wherein providing the instrumentation associated with the casing comprises providing the instrumentation as part of an isolation valve disposed on the casing in the wellbore.

13. The method of claim 1, wherein the instrumentation comprises a pressure sensor measuring an annulus pressure at a depth in the wellbore, the measured pressure being used to determine the initial fluid level of the mud cap in the annulus of the wellbore.

14. The method of claim 1, wherein controlling the drilling in response to the detected change comprises:

determining that the detected change falls within a threshold;

continuing the drilling of the wellbore by pumping the sacrificial fluid through the drillstring without the returns to surface through the annulus; and returning to monitoring the initial fluid level in the annulus to detect a subsequent change.

15. The method of claim 1, wherein controlling the drilling in response to the detected change comprises:

stopping the drilling; and turning off the pumping of the sacrificial fluid down the drillstring.

16. The method of claim 1, wherein controlling the drilling in response to the detected change comprises:

determining that the detected change comprises an increase of the mud cap from the initial fluid level by detecting an increase in pressure measured at a depth in the annulus;

determining that the pressure measured at the depth in the annulus stops increasing and then decreases; and converting from drilling the wellbore with the mud cap to drilling a further extent of the wellbore with a different drilling procedure.

17. The method of claim 1, wherein controlling the drilling in response to the detected change comprises:

determining that the detected change comprises an increase of the mud cap from the initial fluid level by detecting an increase in pressure measured at a depth in the annulus;

determining that the pressure measured at the depth in the annulus stops increasing but does not decrease;

re-evaluating the initial fluid level of the mud cap; and commencing the drilling of a further extent of the wellbore with the mud cap at the re-evaluated fluid level.

18. The method of claim 1, wherein controlling the drilling in response to the detected change comprises:

determining that the detected change comprises an increase of the mud cap from the initial fluid level;

determining that pressure measured in the annulus continues increasing; and bullheading the wellbore.

19. The method of claim 1, wherein controlling the drilling in response to the detected change comprises:

determining that the detected change comprises a decrease of the mud cap from the initial fluid level by detecting a decrease in pressure measured at a depth in the annulus; and bullheading the wellbore.

20. The method of claim 1, wherein controlling the drilling in response to the detected change comprises:

determining that the detected change comprises an increase of the mud cap from the initial fluid level;

measuring for a temperature change in the annular fluid at a depth in the annulus indicative of migration of formation gas in the mud cap; and bullheading the wellbore in response to the measured temperature change indicative of the formation gas migration in the mud cap.

21. The method of claim 1, wherein controlling the drilling in response to the detected change comprises:

determining that the detected change comprises an increase of the mud cap from the initial fluid level;

measuring for a presence of a gas in the annular fluid at a depth in the annulus indicative of migration of formation gas in the mud cap; and bullheading the wellbore in response to the measured presence of the gas indicative of the formation gas migration in the mud cap.

22. A programmable storage device having program instructions stored thereon for causing a programmable control device to perform a method according to claim 1 of drilling a wellbore in a formation of a reservoir.

23. A system for drilling a wellbore in a formation of a reservoir, the system comprising:

instrumentation associated with casing disposed in the wellbore and configured to measure pressure in the wellbore;

fluid handling equipment configured to handle fluid in a drillstring in the wellbore and in an annulus between the drillstring and the wellbore, the handled fluid including drilling fluid, returns, annulus fluid, and sacrificial fluid;

a programmable control device communicatively coupled to the instrumentation and the fluid handling equipment, the programmable control device configured to:

pump the drilling fluid at a drilling rate through the drillstring and allow the returns to the surface through the annulus to drill an open hole section of the wellbore for an extent in the formation in a first stage;

detect during the drilling in the first stage that a static loss rate of the drilling fluid reaches within a loss circulation limit of the drilling rate;

in response to the detection, fill the annulus of the wellbore with a mud cap of the annulus fluid, and define an initial fluid level of the mud cap in the annulus;

pump the sacrificial fluid through the drillstring without the returns to the surface through the annulus to drill the open hole section of the wellbore in a second stage for a subsequent extent beyond the casing while the annulus is filled with the mud cap;

monitor the initial fluid level of the mud cap in the annulus using the instrumentation to detect a change; and control the drilling in response to the detected change.

* * * * *